United States Patent [19]

Simpson

[11] Patent Number: 4,551,707

[45] Date of Patent: Nov. 5, 1985

[54] FIRE ALARM PULL STATION

[75] Inventor: Roger A. Simpson, Lincoln, Nebr.

[73] Assignee: Emhart Industries, Inc., Indianapolis, Ind.

[21] Appl. No.: 382,388

[22] Filed: May 27, 1982

[51] Int. Cl.[4] ..... G08B 25/100

[52] U.S. Cl. ..... 340/287; 340/305

[58] Field of Search ..... 340/287, 304, 302, 303, 340/308, 301; 116/5, 101, 67 R, 100, 75, 85, 86; 49/324; 109/6, 7, 43, 44, 68

[56] References Cited

U.S. PATENT DOCUMENTS

| | | | |
|---|---|---|---|
| 335,025 | 1/1886 | Gaynor | 340/301 |
| 363,948 | 5/1887 | Chase | 340/301 |
| 1,043,975 | 11/1912 | Shier et al. | 340/301 |
| 3,905,027 | 9/1975 | McWilliams | 340/304 |
| 3,938,127 | 2/1976 | Tabet | 340/304 |
| 4,081,796 | 3/1978 | Tabron | 340/304 |
| 4,424,510 | 1/1984 | Hartshorn | 340/304 |

*Primary Examiner*—John W. Caldwell, Sr.
*Assistant Examiner*—Tyrone Queen
*Attorney, Agent, or Firm*—Robert F. Meyer

[57] ABSTRACT

In order to pull a fire alarm door to actuate an alarm, a complimentary door must first be pushed in so as to permit an operator to pull the fire alarm door.

6 Claims, 7 Drawing Figures

FIRE ALARM PULL STATION

BACKGROUND OF THE INVENTION

Generally speaking, the present invention pertains to an alarm station which comprises a frame, a back plate carried by the frame providing a compartment, latch means carried by the back plate, a first door pivotally mounted at end of the frame and partially covering a side opposite the back plate, cam means carried by the first door engaging the latch means, a second door pivotally mounted at an opposite end of the frame and covering the remainder of the side, and a switch responsive to an opening of the first door including means to complete an electrical circuit to an alarm means.

The present invention pertains to an alarm station and more particularly to an alarm station wherein an alarm is sounded when a door is pulled open.

Alarm systems wherein a door is pulled or a glass is broken have long been used to sound a fire alarm. In one type of station, a door is lifted and then the alarm is pulled or in another type a glass is broken and then the alarm is pulled. In either case, the operation of the station can present a potential safety hazard, especially when children are involved. For example, the child can easily pull the door and pull the alarm and in the case of breaking the glass a child, as well as an adult, can be cut by the glass. The present invention admirably overcomes these problems.

FEATURES OR OBJECTS OF THE INVENTION

It is, therefore, an object of the present invention to provide an alarm station which is safer to operate than similar prior art stations. Another feature of the invention is to provide such a station which requires both a push and a pull of complimentary doors to actuate an alarm. Another feature of the invention is to provide such a station wherein an upper door is pushed in to gain access to a lower door to be pulled and actuate an alarm. These and other features of the invention will become apparent from the following description taken in conjunction with the accompanying drawings.

DETAILED DESCRIPTION OF THE INVENTION

Figure 1:
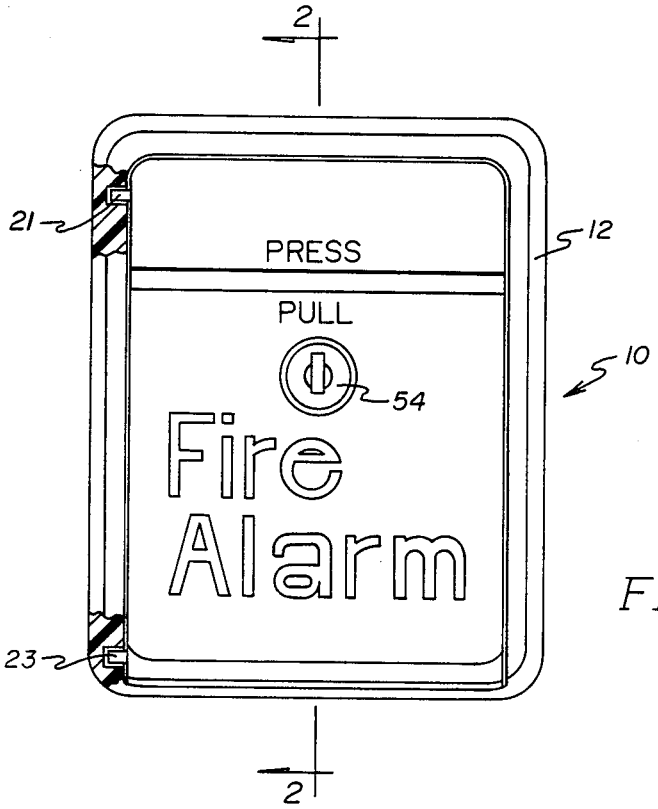
FIG. 1 is a front view of an alarm station employing the features of the invention with portions removed for clarity.
Figure 2:
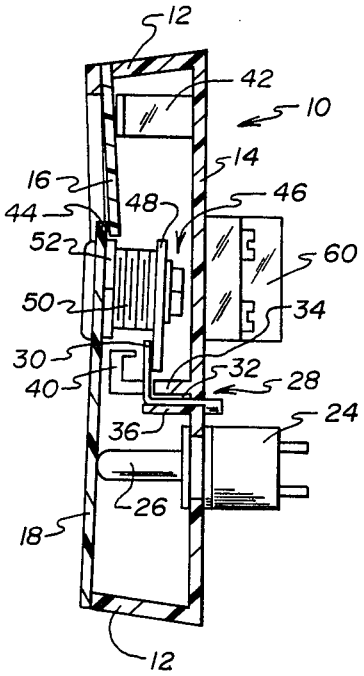
FIG. 2 is a section taken along the lines 2—2 of FIG. 1.

Referring now to FIGS. 1 and 2, there is shown an alarm station 10 employing the features of the invention. In general, the station includes a substantially square frame 12, a back plate 14 carried by the frame and a pair of doors 16 and 18 which are pivotally carried at opposed ends 20 and 22 of the frame at both sides of both doors. As shown, each door is pivotally mounted on a post 21 and 23.

Figure 6A:
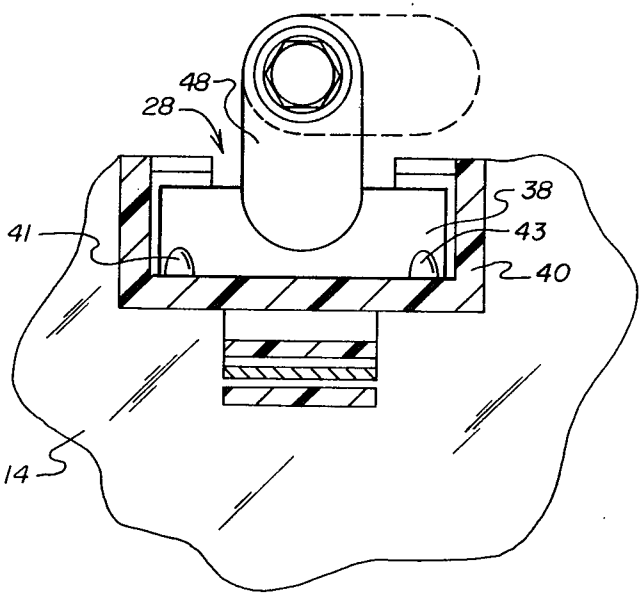
FIGS. 6 and 6*a* are views taken along the lines 6—6 of FIG. 4 showing alternate forms of a latch used in the stations.
Figure 6:
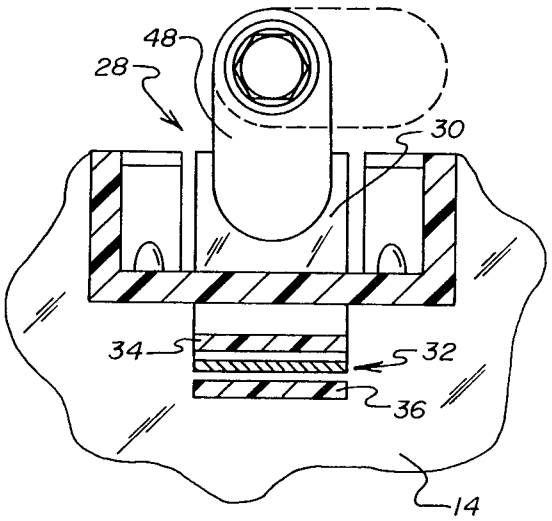

A plunger type switch 24 is carried in the back plate 14 and includes a plunger 26 which is operated upon opening door 18 in a manner to be described. The plunger type switch is of a type commonly used in the art; for example, a switch manufactured by Cutler-Hammer under model No. 8900K263 could be used. Also carried on back plate 14 is a latch means 28. Referring particularly to FIGS. 2, 6 and 6*a*, latch means 28 in one embodiment includes a metal spring 30 carried in a slot 32 provided by walls 34 and 36 extending from the back plate 14. In the embodiment of FIG. 6*a*, latch means 28 includes a glass tube 38 that is carried in a frame 40.

Door 16 is adapted to be pushed inwardly and is biased against spring blade 42 that is carried by back plate 14 so that upon release of the door, the door will return to its original position.

Door 18 carries at its distal end 44 a cam means 46 which cooperates with latch means 28 to retard a pulling of the door. Cam means 48 includes a tab 48 which is fixedly carried on a shaft carried within sleeve 50 which is fixedly attached to the door through a nut 52. A tumbler 54 is carried on the end of the shaft and is adapted to receive a key so that the shaft can be rotated through insertion of the key and rotating the tumbler.

A terminal block 60 is also carried on back plate 14 and is adapted to receive electrical terminals for wiring from plunger switch 24 and to an alarm (not shown).

Figure 5:
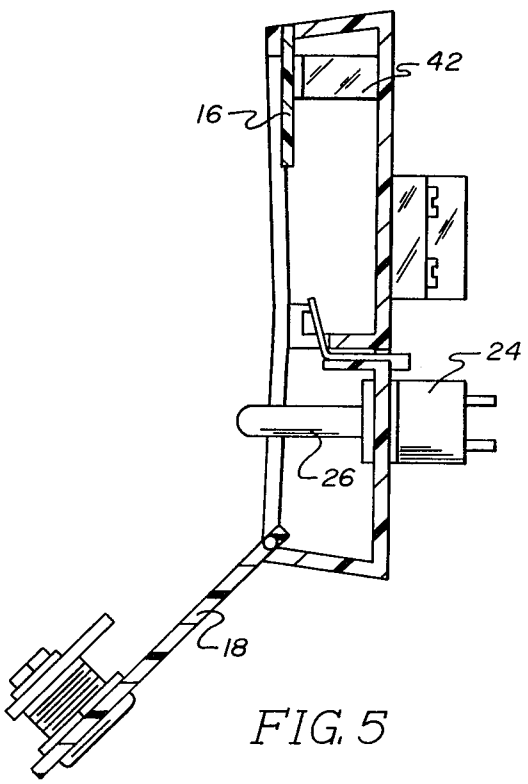
FIGS. 3–5 are views similar to FIG. 2 showing different operating modes of the station.
Figure 4:
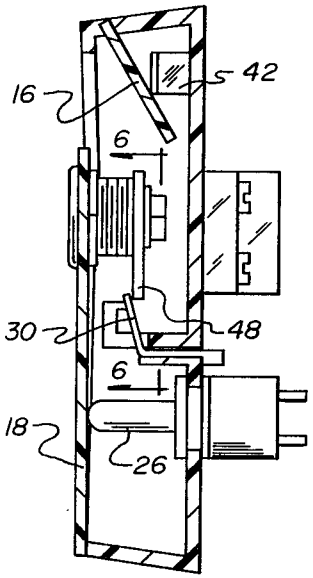
Figure 3:
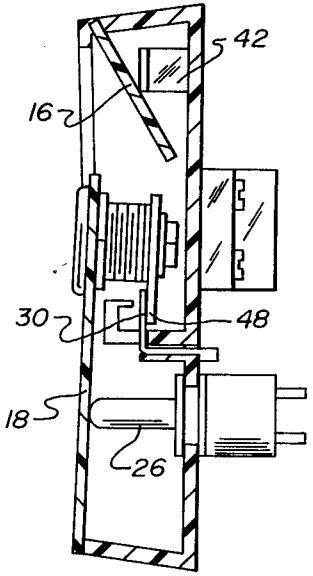

Referring now to FIGS. 2–5, the operation of the alarm station can be described. FIG. 2 illustrates the station in an "at rest position." More specifically, the person responsible for the station has used a key to rotate tab 48 to be engaged with spring 30. In FIG. 3, door 16 has been depressed or pushed "in in order to be able to grab door 18 and pull it out." In FIG. 4, door 18 has begun to be pulled out. Note that tab 48 has started to become disengaged from spring 30. In FIG. 5, door 18 has been pulled completely open to release plunger 26 to close switch 24 to complete an electrical circuit to an alarm (not shown). Door 16 has swung closed due to spring 42.

To reset the alarm, door 18 has to be closed by the key operator and in the case of the use of the glass tube of the embodiment of FIG. 6*a*, the tube would have to be replaced.

What is claimed is:

1. A double action alarm station comprising:

(a) a frame, (b) a back plate carried by said frame providing a compartment, (c) latch means carried by said back plate, (d) a first door pivotally mounted at an end of said frame to be manually pushed inwardly and partially covering a side opposite said back plate, (e) a second door pivotally mounted at an opposite end of said frame to be manually pulled outwardly after pushing said first door inwardly and covering the remainder of said side, (f) cam means carried by said second door engaging said latch means, and (g) a switch closing in response to an opening of said second door and having a terminal block receiving electrical wiring from an alarm to complete an electrical circuit thereto.

2. A double action alarm station according to claim 1 wherein said latch means includes a spring blade.

3. A double action alarm station according to claim 1 wherein said latch means includes a glass element.

4. A double action alarm station according to claim 1 wherein said cam means includes a tab carried on a shaft rotatably mounted in said first door.

5. A double action alarm station according to claim 4 wherein said shaft includes a tumbler adapted to receive a key to rotate said shaft.

6. A double action alarm station according to claim 1 wherein said switch is a plunger type switch and wherein an opening of said first door releases a plunger to close said switch.

* * * * *